US011952700B2

(12) United States Patent
Xu et al.

(10) Patent No.: US 11,952,700 B2
(45) **Date of Patent: *Apr. 9, 2024**

(54) DRUM WASHING MACHINE, AND CONTROL METHOD AND APPARATUS FOR SAME

(71) Applicant: GUANGDONG WELLING MOTOR MANUFACTURING CO., LTD., Foshan (CN)

(72) Inventors: Lei Xu, Foshan (CN); Liming Gong, Foshan (CN); Xiangnan Qin, Foshan (CN)

(73) Assignee: GUANGDONG WELLING MOTOR MANUFACTURING CO., LTD., Foshan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/177,518

(22) Filed: Mar. 2, 2023

(65) Prior Publication Data

US 2023/0203733 A1 Jun. 29, 2023

Related U.S. Application Data

(63) Continuation of application No. 15/882,830, filed on Jan. 29, 2018, now Pat. No. 11,618,987, which is a (Continued)

(30) Foreign Application Priority Data

Jul. 31, 2015 (CN) ..... 201510469425.1

(51) Int. Cl.
*D06F 33/48* (2020.01)
*D06F 34/18* (2020.01)

(Continued)

(52) U.S. Cl.
CPC ..... *D06F 33/48* (2020.02); *D06F 33/40* (2020.02); *D06F 34/18* (2020.02); *D06F 37/42* (2013.01);

(Continued)

(58) Field of Classification Search
CPC ..... D06F 33/00; D06F 34/18; D06F 37/203; D06F 37/304; D06F 2202/065; D06F 2202/12

(Continued)

(56) References Cited

U.S. PATENT DOCUMENTS 4,556,827 A 12/1985 Erdmar
4,607,408 A 8/1986 Didier et al.

(Continued)

FOREIGN PATENT DOCUMENTS

CN 102086581 A 6/2011
CN 103025946 A 4/2013

(Continued)

OTHER PUBLICATIONS

First Office Action dated Sep. 18, 2016 received in Chinese Patent Application No. 201510469425.1.

(Continued)

*Primary Examiner* — David G Cormier
*Assistant Examiner* — Thomas Bucci
(74) *Attorney, Agent, or Firm* — SCULLY, SCOTT, MURPHY & PRESSER, P.C.

(57) ABSTRACT

A drum washing machine, and a control method and a control apparatus for same are provided. The control method for the drum washing machine comprises the following steps: acquiring an average starting power of a drum in a starting process of the drum; acquiring a load range to which a current load of the drum belongs according to the average starting power; and setting a weighing protection velocity (Continued)

fluctuation threshold according to the load range to which the current load of the drum belongs. A value of the current load is obtained by using a correspondence between load with different weights and average starting powers. A weighing protection velocity fluctuation threshold is set according to the value of the current load to avoid the collision with the drum and non-dehydration in case of only one piece of clothing.

4 Claims, 4 Drawing Sheets

Related U.S. Application Data continuation of application No. PCT/CN2016/092107, filed on Jul. 28, 2016.

(51) Int. Cl.

| | |
|---|---|
| ***D06F 103/04*** | (2020.01) |
| ***D06F 103/46*** | (2020.01) |
| ***D06F 105/48*** | (2020.01) |
| *D06F 33/40* | (2020.01) |
| *D06F 37/42* | (2006.01) |

(52) U.S. Cl.
CPC ..... *D06F 2103/04* (2020.02); *D06F 2103/46* (2020.02); *D06F 2105/48* (2020.02)

(58) Field of Classification Search
USPC .. 68/12.02, 12.06, 12.04, 12.12, 12.27, 140, 68/23.3; 8/137, 158, 159, 149.1
See application file for complete search history.

(56) References Cited

U.S. PATENT DOCUMENTS

| | | | | |
|---|---|---|---|---|
| 5,038,091 | A | 8/1991 | Bashark | |
| 5,144,819 | A | 9/1992 | Hiyama et al. | |
| 5,161,393 | A | 11/1992 | Payne et al. | |
| 5,230,228 | A | 7/1993 | Nakano et al. | |
| 5,233,847 | A | 8/1993 | Tanaka | |
| 5,293,760 | A | 3/1994 | Tani et al. | |
| 5,768,729 | A | 6/1998 | Cracraft | |
| 5,852,881 | A | 12/1998 | Kuroda et al. | |
| 5,897,672 | A | 4/1999 | Badami et al. | |
| 6,158,072 | A | 12/2000 | Baek et al. | |
| 6,240,586 | B1 | 6/2001 | Joo | |
| 6,282,965 | B1 | 9/2001 | French et al. | |
| 6,381,791 | B1 | 5/2002 | French et al. | |
| 6,418,581 | B1 | 7/2002 | Bruce et al. | |
| 6,637,062 | B2 | 10/2003 | Braun et al. | |
| 6,715,175 | B2 * | 4/2004 | Ciancimino | D06F 34/16 68/12.27 |
| 8,042,211 | B2 * | 10/2011 | Stansel | D06F 33/48 8/159 |
| 9,080,277 | B2 | 7/2015 | Erickson et al. | |
| 9,243,987 | B2 | 1/2016 | Chanda et al. | |
| 9,518,351 | B2 * | 12/2016 | Dedow | D06F 37/36 |
| 9,758,913 | B2 | 9/2017 | Obregon | |
| 9,863,080 | B2 | 1/2018 | Fugal et al. | |
| 9,873,968 | B2 | 1/2018 | Janke et al. | |
| 9,988,751 | B2 | 6/2018 | Fugal et al. | |
| 10,041,202 | B2 | 8/2018 | Sumer et al. | |
| 10,060,067 | B2 | 8/2018 | K et al. | |
| 10,273,621 | B2 | 4/2019 | Borlin et al. | |
| 10,577,739 | B2 * | 3/2020 | Dedow | D06F 33/48 |
| 11,618,987 | B2 * | 4/2023 | Xu | D06F 33/48 68/12.02 |
| 2001/0054204 | A1 | 12/2001 | Ciancimino et al. | |
| 2003/0009832 | A1 | 1/2003 | Yang et al. | |
| 2004/0066303 | A1 | 4/2004 | Chernetski | |
| 2004/0211009 | A1 | 10/2004 | Murray et al. | |
| 2005/0204482 | A1 | 9/2005 | Murray et al. | |
| 2005/0283918 | A1 | 12/2005 | Zhang et al. | |
| 2005/0284192 | A1 | 12/2005 | Altinier et al. | |
| 2005/0288885 | A1 | 12/2005 | Zhang et al. | |
| 2006/0185095 | A1 | 8/2006 | Mitts | |
| 2006/0242768 | A1 | 11/2006 | Zhang et al. | |
| 2007/0039106 | A1 | 2/2007 | Stansel et al. | |
| 2007/0294838 | A1 | 12/2007 | Croxton | |
| 2008/0041115 | A1 | 2/2008 | Kanazawa et al. | |
| 2008/0156094 | A1 | 7/2008 | Holmes et al. | |
| 2008/0289118 | A1 | 11/2008 | Park et al. | |
| 2009/0199598 | A1 | 8/2009 | Kanazawa | |
| 2011/0030149 | A1 * | 2/2011 | Cho | D06F 34/08 8/137 |
| 2011/0030460 | A1 * | 2/2011 | Ashrafzadeh | D06F 34/18 68/12.04 |
| 2011/0067186 | A1 | 3/2011 | Johansson | |
| 2011/0098869 | A1 * | 4/2011 | Seo | H04L 41/0833 700/296 |
| 2011/0185513 | A1 | 8/2011 | Suel, II et al. | |
| 2011/0303252 | A1 | 12/2011 | Marioni | |
| 2012/0192450 | A1 * | 8/2012 | Kim | D06F 25/00 68/12.03 |
| 2012/0193985 | A1 | 8/2012 | Kim et al. | |
| 2012/0324654 | A1 * | 12/2012 | Koo | D06F 33/32 68/12.12 |
| 2013/0160216 | A1 * | 6/2013 | Buendia | D06F 33/32 68/12.04 |
| 2013/0160221 | A1 * | 6/2013 | Ashrafzadeh | D06F 33/48 68/12.04 |
| 2014/0013518 | A1 | 1/2014 | Janke et al. | |
| 2015/0059416 | A1 * | 3/2015 | Naber | D06F 33/48 73/66 |
| 2015/0134125 | A1 * | 5/2015 | Dedow | D06F 37/36 700/279 |
| 2018/0148880 | A1 | 5/2018 | Xu et al. | |

FOREIGN PATENT DOCUMENTS

| | | | | |
|---|---|---|---|---|
| CN | 103225195 | A | * | 7/2013 |
| CN | 103225195 | A | | 7/2013 |
| CN | 103925979 | A | | 7/2014 |
| CN | 103966799 | A | | 8/2014 |
| CN | 104593996 | A | | 5/2015 |
| JP | H10-305189 | A | | 11/1998 |
| JP | 2001-334096 | A | * | 12/2001 |
| JP | 2001334096 | A | | 12/2001 |
| JP | 2009131965 | A | | 6/2009 |
| JP | 2014-64918 | A | | 4/2014 |

OTHER PUBLICATIONS

Notification of Reasons for Refusal dated Mar. 5, 2019 received in Japanese Patent Application No. 2018-505010.
Notice of Reasons for Refusal dated Oct. 1, 2019 received in Japanese Patent Application No. 2018-505010.
Notification of Reason for Refusal dated Feb. 18, 2019 received in Korean Patent Application No. 10-2018-7005744.
Office Action dated Mar. 31, 2020 received in U.S. Appl. No. 15/882,830.
Office Action dated Oct. 26, 2020 received in U.S. Appl. No. 15/882,830.
Office Action dated Jun. 4, 2021 received in U.S. Appl. No. 15/882,830.
Office Action dated Nov. 17, 2021 received in U.S. Appl. No. 15/882,830.
Office Action dated May 20, 2022 received in U.S. Appl. No. 15/882,830.
Notice of Allowance dated Dec. 13, 2022 received in U.S. Appl. No. 15/882,830.

* cited by examiner

DRUM WASHING MACHINE, AND CONTROL METHOD AND APPARATUS FOR SAME

CROSS-REFERENCE TO RELATED APPLICATIONS

This application is a continuation application of U.S. application Ser. No. 15/882,830 filed on Jan. 29, 2018, which is a continuation application of PCT/CN2016/092107, entitled "DRUM WASHING MACHINE, AND CONTROL METHOD AND APPARATUS FOR SAME" and filed on Jul. 28, 2016, which claims priority to Chinese Patent Application No. 201510469425.1, filed with the State Intellectual Property Office of the People's Republic of China on Jul. 31, 2015, the entire contents of each of which are incorporated herein by reference for all purposes. No new matter has been introduced.

TECHNICAL FIELD

The present disclosure relates to a field of washing machine detection and control technology, and more particularly to a drum washing machine, and a control method and a control apparatus for the same.

BACKGROUND

For a drum washing machine, when a load of a variable-frequency electric motor is not balanced, the higher a rotation velocity of the variable-frequency electric motor is, the greater vibration and noise of a system will be, thus reducing the service life of the machine. This situation is particularly prominent on the drum washing machine. The variable-frequency electric motor has a load imbalance detection function, and if any load imbalance is detected, the vibration and noise of the system can be reduced by adjusting the rotation velocity of the electric motor or changing the state of load imbalance.

The load imbalance detection in theory is related to two variables of rotation velocity fluctuation and load inertia. Inertia identification requires acceleration and deceleration processes to get a relatively accurate inertia value, but the acceleration process may result in collision with the drum or displacement of the drum due to an excessive eccentric load, which is not allowed in the washing machine application. Therefore, a magnitude of the rotation velocity fluctuation is usually used for eccentric protection before the inertia identification, so as to ensure safety of the inertia identification process. However, during experiments, it has been found that the collision with the drum still occurs in a weighing process, so a pre-weighing process with a low accuracy requirement is performed here before computation of the rotation velocity fluctuation. With different pre-weighing values, a weighing protection threshold is also set correspondingly to be different, so as to ensure safety of the weighing process.

The following is a theoretical analysis about whether any problem will occur when the rotation velocity fluctuation is used for the weighing protection. As illustrated in FIG. 1, presented is a corresponding relationship between an eccentric mass and the rotation velocity fluctuation for an 8 kg-capacity washing machine.

As seen from FIG. 1, the velocity fluctuation corresponding to the same eccentric mass will be decreased as the load increases. There are two limiting conditions for setting the weighing protection threshold, the first condition is that the threshold cannot be too big to cause the collision with the drum, and the second condition is that the threshold cannot be too small to result in failure of dehydration in a case of only one piece of clothes, especially for a load of a single bath towel or a pair of jeans. Based on these two limiting conditions, a conventional weighing protection solution chooses a working point of 0% load and 800 g eccentric mass, that is, a velocity fluctuation threshold is set to be about 170 rpm. As a result, an eccentric mass corresponding to this threshold under an 80% load is computed to have a value of 4.2 kg, and for this eccentric mass, the collision with the drum will definitely occur in the weighing process. From the above analysis, we can see that the conventional weighing protection solution in theory has inherent defects and fails to play a protection role in the case of heavy loads.

In conclusion, the control method for the drum washing machine in the prior art has the problems of collision with the drum in the weighing process and failure of dehydration for one piece of clothes.

SUMMARY

An objective of the present disclosure is to provide a drum washing machine, and a control method and a control apparatus for the same, aiming to solve problems existing in a control method for a washing machine in the prior art, i.e. collision with a drum in a weighing process and failure of dehydration for one piece of clothes.

The present disclosure is achieved by a control method for a drum washing machine. The control method includes following steps: step A, acquiring an average starting power of a drum in a starting process of the drum; step B, acquiring a load range to which a current load of the drum belongs according to the average starting power; and step C, setting a velocity fluctuation threshold for weighing protection according to the load range to which the current load of the drum belongs.

The present disclosure further provides a control apparatus for a washing machine. The control apparatus includes: an average-starting-power acquiring module configured to acquire an average starting power of a drum in a starting process of the drum; a load acquiring module configured to acquire a load range to which a current load of the drum belongs according to the average starting power; and a velocity-fluctuation-threshold acquiring module configured to set a velocity fluctuation threshold for weighing protection according to the load range to which the current load of the drum belongs.

The present disclosure further provides a washing machine, including a drum and the above control apparatus for the washing machine.

With the drum washing machine as well as the control method and apparatus for the drum washing machine, a value of the current load is obtained by using the corresponding relationship between the loads with different weights and the average starting powers, and the velocity fluctuation threshold for weighing protection is set according to the value of the current load, so as to avoid the phenomena of collision with the drum and failure of dehydration in the case of only one piece of clothes. This solution completes computation in a starting stage, and can be implemented by only a few modifications on the basis of the conventional solution without the need to add extra control logic, thereby being convenient and practical, and lowering an upgrade cost of a whole product.

DETAILED DESCRIPTION

In order to make the objectives, technical solutions and advantages of the present disclosure clearer and more comprehensible, the present disclosure will be further described in detail below with reference to the accompanying drawings and embodiments. It should be understood that the specific embodiments described herein are only used to explain the present disclosure and are not intended to limit the present disclosure.

Figure 1:
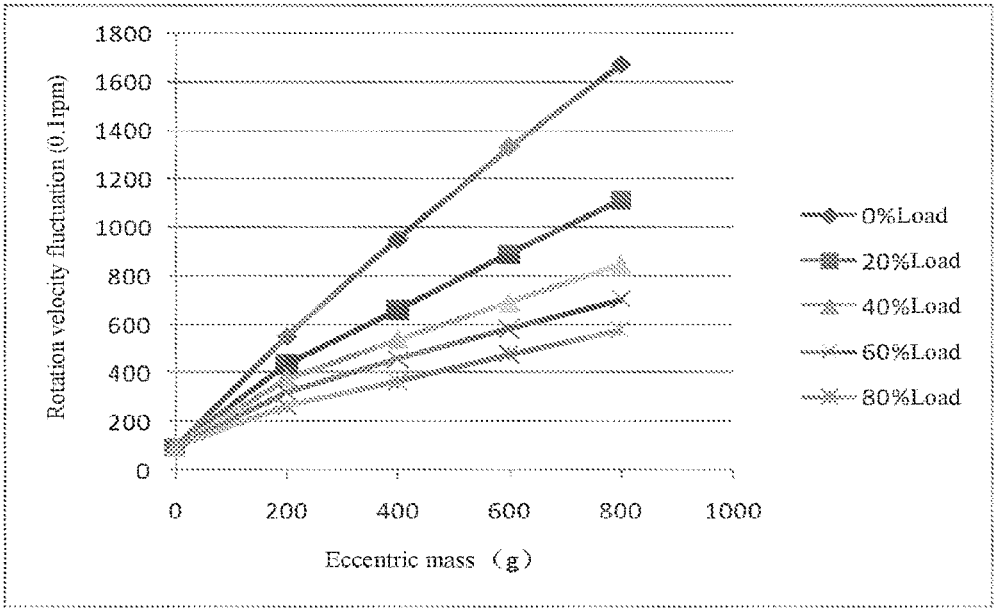
FIG. 1 shows a relationship between an eccentric mass and a rotation velocity fluctuation of a drum under different loads in a drum washing machine provided in the prior art.
Figure 2:
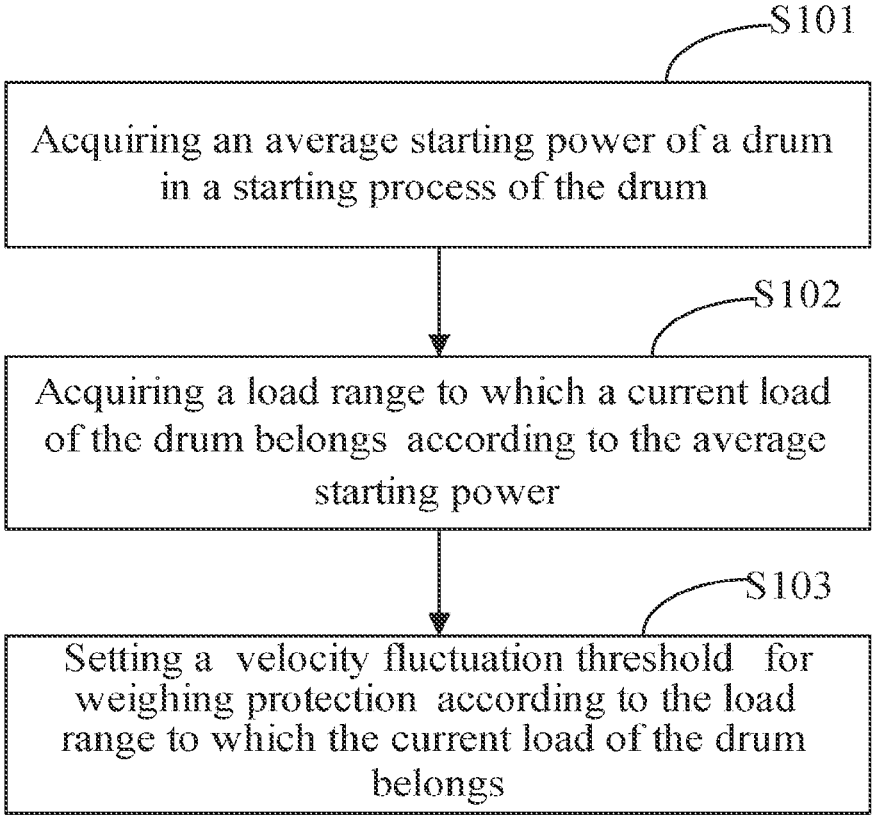
FIG. 2 is a flow chart for implementing a control method for a drum washing machine according to an embodiment of the present disclosure.

FIG. 2 shows a flow chart for implementing a control method for a drum washing machine according to an embodiment of the present disclosure. For convenience of illustration, only a part related to the embodiment of the present disclosure is shown, and details are as follows. The control method includes the following steps.

In step S101, an average starting power of a drum is acquired in a starting process of the drum.

Specifically, the acquisition of the average starting power of the drum in step S101 is realized by acquiring a starting power of the drum and integrating the starting power for a duration of start-up of the drum.

In step S102, a load range to which a current load of the drum belongs is acquired according to the average starting power.

Before step S102, the method further includes pre-storing a corresponding relationship between a threshold for the average starting power and the load range.

As indicated by Table 1, a result of a test on the starting power of an 8 kg-capacity washing machine is shown as follows.

TABLE 1

| Corresponding relationship between load and average starting power | | | | | |
|---|---|---|---|---|---|
| Load | 0% | 20% | 40% | 60% | 80% |
| Average starting power (W) | 18 | 63 | 90 | 111 | 125 |

Based on the average starting power, it is possible to identify the respective current loads of the drum are 0%, 20%, 40%, 60% and 80%.

According to the above corresponding relationship between the load and the average starting power, the load range is obtained by setting the threshold for the average starting power.

Figure 3:
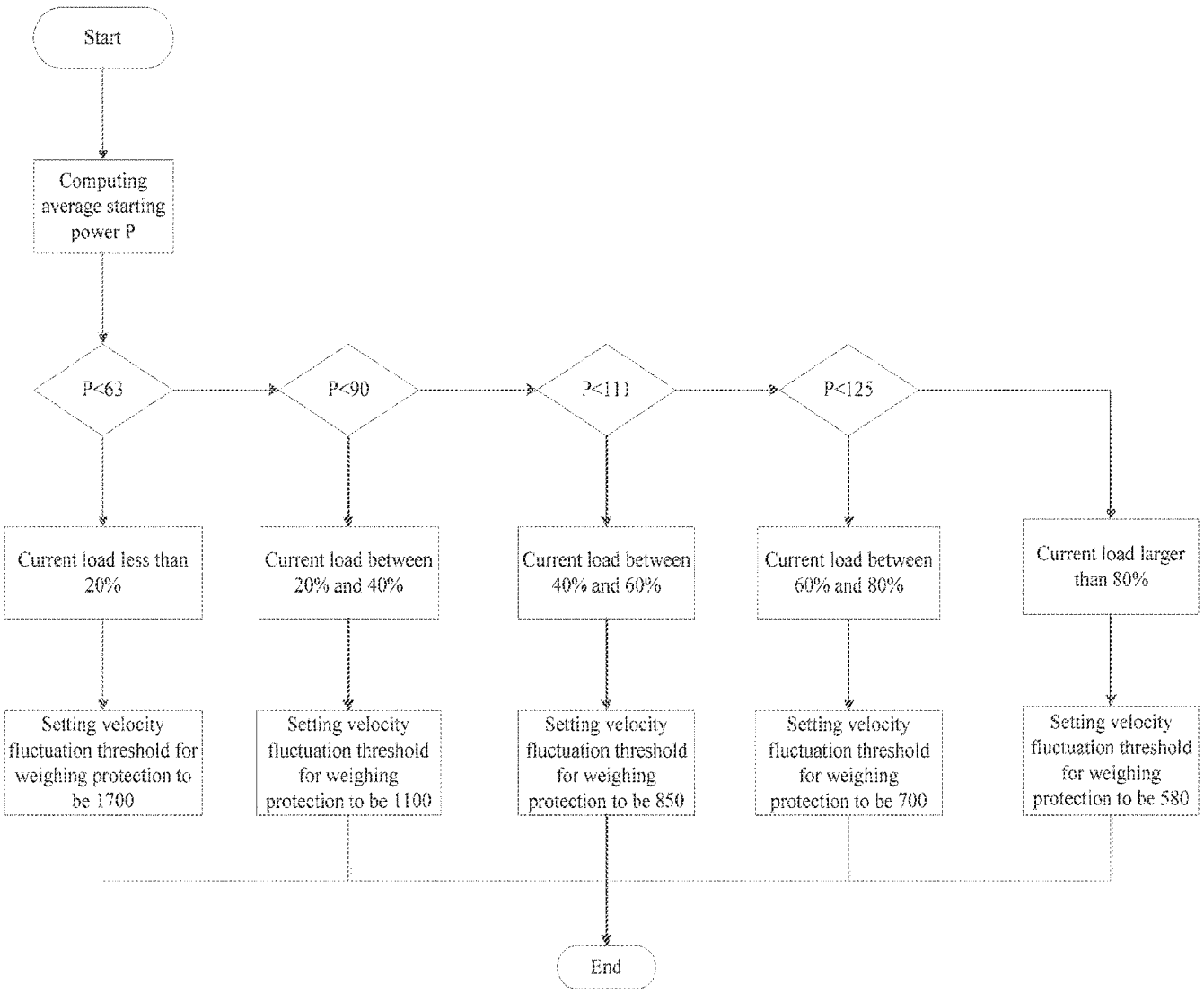
FIG. 3 is another flow chart for implementing a control method for a drum washing machine according to an embodiment of the present disclosure.

As illustrated in FIG. 3, step S102 is specifically realized by judging whether the average starting power is smaller than a first threshold for the average starting power; if yes, determining that the current load of the drum belongs to a first load range; if no, judging whether the average starting power is smaller than a second threshold for the average starting power; if yes, determining that the current load of the drum belongs to a second load range; if no, judging whether the average starting power is smaller than a third threshold for the average starting power; if yes, determining that the current load of the drum belongs to a third load range; if no, judging whether the average starting power is smaller than a fourth threshold for the average starting power; if yes, determining that the current load of the drum belongs to a fourth load range; if no, determining that the current load of the drum belongs to a fifth load range.

The first threshold for the average starting power is set to be 63 W, and the first load range is that the current load is less than 20% of the drum load; the second threshold for the average starting power is set to be 90 W, and the second load range is that the current load is between 20% and 40% of the drum load; the third threshold for the average starting power is set to be 111 W, and the third load range is that the current load is between 40% and 60% of the drum load; the fourth threshold for the average starting power is set to be 125 W, and the fourth load range is that the current load is between 60% and 80% of the drum load; the fifth load range is that the current load is greater than 80% of the drum load.

In step S103, a velocity fluctuation threshold for weighing protection is set according to the load range to which the current load of the drum belongs.

Before step S103, the method further includes pre-storing a corresponding relationship between the load range and the velocity fluctuation threshold for weighing protection.

Still by example of the 8 kg-capacity washing machine, a maximum dehydration eccentric mass is allowed to be 800 g, and if the eccentric mass exceeds 800 g, dehydration noise will be large and a high-speed dehydration displacement will be caused. Meanwhile, a maximum eccentric mass allowed in a weighing process is 1400 g, and if the eccentric mass exceeds 1400 g, collision with the drum will occur in the weighting process. In order to guarantee dehydration, in the case of the eccentric mass being less than 800 g, the weighing process should be entered, while in the case of the eccentric mass being greater than 1400 g, the weighing process is not allowed to be entered. Therefore, an eccentric mass threshold for weighing protection should be ensured to be between 800 g and 1400 g under each load condition herein.

Table 2 shows velocity fluctuation data tested under different loads. Form the table, we can see that a maximum dehydration eccentric velocity fluctuation in a condition of 0% load is 1700, and a maximum weighing safety eccentric velocity fluctuation in a condition of less than 20% load is 1800. Thus, when the load is between 0% and 20%, the velocity fluctuation threshold for weighing protection can be selected as 1700, such that it is possible to ensure that the weighing process can be entered when the eccentric mass is less than 800 g, and the load weighing process cannot be entered under the load above 1400 g. The situations under other load conditions are similar.

TABLE 2

Velocity fluctuation data obtained by testing different loads

| Load | Maximum dehydration eccentric mass (g) | Maximum dehydration eccentric velocity fluctuation (0.1 rpm) | Maximum weighing safety eccentric mass (g) | Maximum weighing safety eccentric velocity fluctuation (0.1 rpm) |
|---|---|---|---|---|
| 0% | 800 | 1700 | 1400 | 3300 |
| 20% | 800 | 1100 | 1400 | 1800 |
| 40% | 800 | 850 | 1400 | 1200 |
| 60% | 800 | 700 | 1400 | 900 |
| 80% | 800 | 580 | 1400 | 750 |

Therefore, according to the corresponding relationship between the load and the maximum dehydration eccentric velocity fluctuation, when the current load of the drum is in the first load range, the velocity fluctuation threshold for weighing protection is set to be 1700 rpm; when the current load of the drum is in the second load range, the velocity fluctuation threshold for weighing protection is set to be 1100 rpm; when the current load of the drum is in the third load range, the velocity fluctuation threshold for weighing protection is set to be 850 rpm; when the current load of the drum is in the fourth load range, the velocity fluctuation threshold for weighing protection is set to be 700 rpm; when the current load of the drum is in the fifth load range, the velocity fluctuation threshold for weighing protection is set to be 580 rpm.

With the control method for the drum washing machine according to the present disclosure, a value of the current load is obtained by using the corresponding relationship between the loads of different weights and the average starting powers, and the velocity fluctuation threshold for weighing protection is set according to the value of the current load, so as to avoid the phenomena of collision with the drum and failure of dehydration in the case of only one piece of clothes. This solution completes computation in a starting stage, and can be implemented by only a few modifications on the basis of the conventional solution without the need to add extra control logic, thereby being convenient and practical, and lowering an upgrade cost of the whole product.

Figure 4:
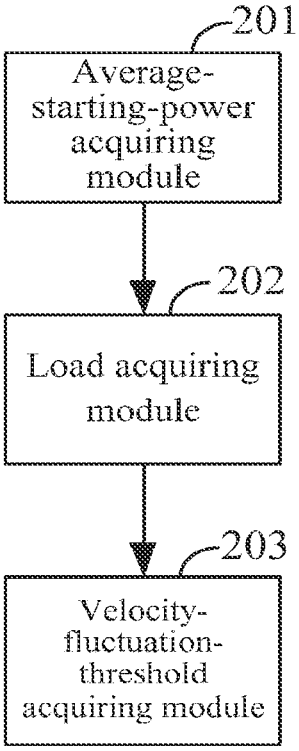
FIG. 4 is a schematic view of a control apparatus for a drum washing machine according to an embodiment of the present disclosure.

Another embodiment of the present disclosure provides a control apparatus for a drum washing machine. As shown in FIG. 4, the control apparatus for the drum washing machine includes: an average-starting-power acquiring module 201 configured to acquire an average starting power of a drum in a starting process of the drum; a load acquiring module 202 configured to acquire a load range to which a current load of the drum belongs according to the average starting power; and a velocity-fluctuation-threshold acquiring module 203 configured to set a velocity fluctuation threshold for weighing protection according to the load range to which the current load of the drum belongs.

The average-starting-power acquiring module acquires the average starting power of the drum by acquiring a starting power of the drum and integrating the starting power for the duration of start-up of the drum.

The control apparatus for the drum washing machine includes a storing module configured to pre-store a corresponding relationship between a threshold for the average starting power and the load range, and pre-store a corresponding relationship between the load range and a velocity fluctuation threshold for weighing protection.

The load acquiring module acquires the load range to which the current load of the drum belongs, according to the average starting power, through following actions: judging whether the average starting power is smaller than a first threshold for the average starting power; if yes, determining that the current load of the drum belongs to a first load range; if no, judging whether the average starting power is smaller than a second threshold for the average starting power; if yes, determining that the current load of the drum belongs to a second load range; if no, judging whether the average starting power is smaller than a third threshold for the average starting power; if yes, determining that the current load of the drum belongs to a third load range; if no, judging whether the average starting power is smaller than a fourth threshold for the average starting power; if yes, determining that the current load of the drum belongs to a fourth load range; if no, determining that the current load of the drum belongs to a fifth load range.

The first threshold for the average starting power is set to be 63 W, and the first load range is that the current load is less than 20% of the drum load; the second threshold for the average starting power is set to be 90 W, and the second load range is that the current load is between 20% and 40% of the drum load; the third threshold for the average starting power is set to be 111 W, and the third load range is that the current load is between 40% and 60% of the drum load; the fourth threshold for the average starting power is set to be 125 W, and the fourth load range is that the current load is between 60% and 80% of the drum load; the fifth load range is that the current load is greater than 80% of the drum load.

When the current load of the drum is in the first load range, the velocity fluctuation threshold for weighing protection is set to be 1700 rpm; when the current load of the drum is in the second load range, the velocity fluctuation threshold for weighing protection is set to be 1100 rpm; when the current load of the drum is in the third load range, the velocity fluctuation threshold for weighing protection is set to be 850 rpm; when the current load of the drum is in the fourth load range, the velocity fluctuation threshold for weighing protection is set to be 700 rpm; when the current load of the drum is in the fifth load range, the velocity fluctuation threshold for weighing protection is set to be 580 rpm.

Figure 5:
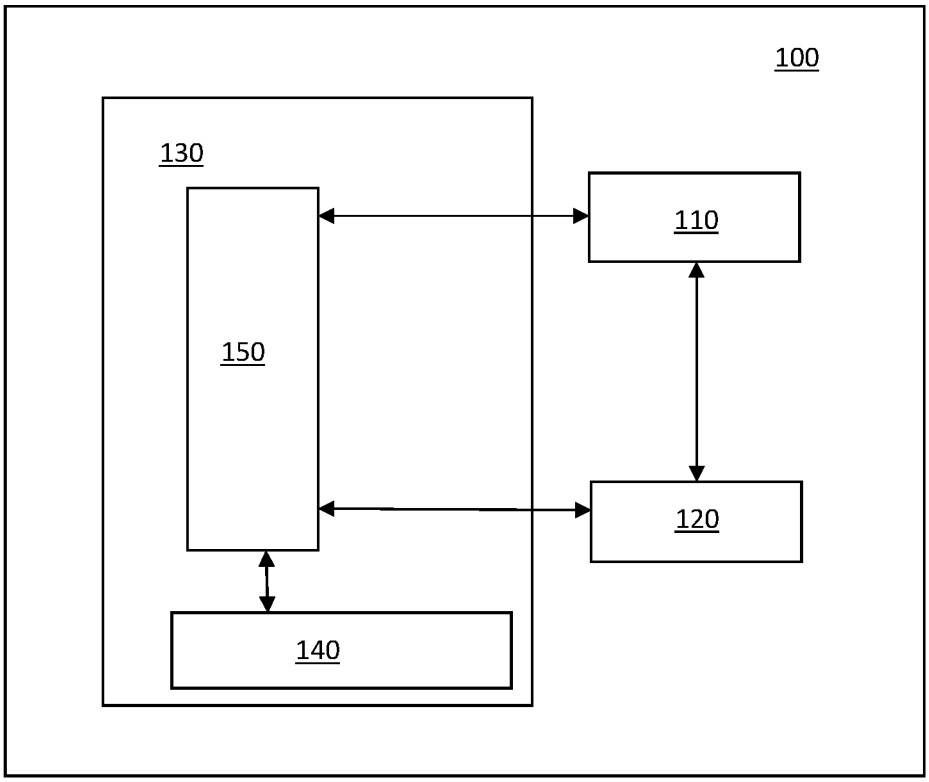
FIG. 5 is a schematic block diagram of a drum washing machine according to another embodiment of the present disclosure.

FIG. 5 illustrates schematically a drum washing machine 100 according to another embodiment of the present application. The drum washing machine 100 includes a drum 110 and a motor 120, as commonly known in the industry. The drum washing machine 100 further includes a control apparatus 130, which functions to control the drum and the motor of the washing machine. The control apparatus 130 can include a memory 140 that is configured to store a program including program code, and a processor 150 that is configured to execute the program stored in the memory to execute and implement the steps S101-S103 shown in FIG. 2 and described with respect to FIG. 2.

The present disclosure further provides another preferable embodiment of the control apparatus for the drum washing machine. In this embodiment, the control apparatus 130 includes the processor 150 configured to execute program modules stored in a memory, which correspond to the steps S101-S103 of the method shown in FIG. 2, respectively. The program modules includes: an average-starting-power acquiring module 201 configured to acquire an average starting power of a drum in a starting process of the drum; a load acquiring module 202 configured to acquire a load range to which a current load of the drum belongs according to the average starting power; and a velocity-fluctuation-threshold acquiring module 203 configured to set a velocity fluctuation threshold for weighing protection according to the load range to which the current load of the drum belongs.

Specifically, the control apparatus for the drum washing machine incudes the processor, a communication interface, the memory and a bus.

The processor, the communication interface and the memory achieve mutual communication by means of the bus.

The communication interface is configured to communicate with a network element, such as a virtual machine management center, a shared memory or the like.

The processor is configured to execute a program.

Specifically, the program may include a program code that contains a computer operation instruction.

The processor may be a central processing unit (CPU), or an application specific integrated circuit (ASIC), or one or more integrated circuits configured to implement the embodiment of the present disclosure.

The memory is configured to store the program. The memory may include a high-speed random access memory (RAM), and may also include a non-volatile memory, for example at least one magnetic disk memory. The program may specifically include: the average-starting-power acquiring module 201 configured to acquire the average starting power of the drum in the starting process of the drum; the load acquiring module 202 configured to acquire the load range to which the current load of the drum belongs according to the average starting power; and the velocity-fluctuation-threshold acquiring module 203 configured to set the velocity fluctuation threshold for weighing protection according to the load range to which the current load of the drum belongs.

For the specific implementation of each unit in the program, reference can be made to the corresponding units in the embodiment shown in FIG. 4, which will not be elaborated herein.

Those skilled in the art can clearly understand that, for convenience and simplicity of description, regarding specific working processes of the foregoing system, apparatus and module, reference can be made to corresponding processes in the foregoing method embodiment, which will not be elaborated herein.

In the several embodiments provided in the present application, it should be understood that the disclosed system, apparatus and method may be implemented in other manners. For example, the apparatus embodiment described above is merely exemplary. For example, the division of units is a merely logical function division and may include another division in actual implementations. For example, multiple units or components may be combined or integrated into another system, or some features may be ignored or not executed. In addition, the shown or discussed mutual coupling or direct coupling or communication connection may be indirect coupling or communication connection through some communication interfaces, devices or units, and may be electrical, mechanical or in other forms.

The units described as separate components may be or may not be physically separate. The component presented as the unit may be or may not be a physical unit, i.e. may be located at a position or may be distributed at many network elements. It is possible to select part of or all of the units to realize the objective of the present disclosure.

In addition, various functional units in various embodiments of the present disclosure may be integrated in one processing unit, or the various units may exist alone physically, or two or more units may be integrated in one unit.

When the function is realized in a form of a software function unit and is sold or used as a standalone product, it may be stored in a computer readable storage medium. Based on this understanding, the technical solution of the present disclosure essentially, or the part thereof contributing to the prior art, or the part of the technical solution can be embodied in a form of a software product. The computer software product is stored in a storage medium and includes several instructions for enabling a computer device (which may be a personal computer, a server, or a network device) to execute all or part of the steps of the method according to various embodiments of the present disclosure. The foregoing storage medium includes various media capable of storing a program code, such as a USB flash disk, a removable hard disk, a read-only memory (ROM), a random access memory (RAM), a magnetic disk, or an optical disk.

Yet another embodiment of the present disclosure provides a drum washing machine, including a drum and the above control apparatus for the drum washing machine.

With the drum washing machine as well as the control method and apparatus for the drum washing machine, a value of the current load is obtained by using the corresponding relationship between the loads of different weights and the average starting powers, and the velocity fluctuation threshold for weighing protection is set according to the value of the current load, so as to avoid the phenomena of collision with the drum and failure of dehydration in the case of only one piece of clothes. This solution completes computation in the starting stage, and can be implemented by only a few modifications on the basis of the conventional solution without the need to add extra control logic, thereby being convenient and practical, and lowering an upgrade cost of the whole product.

The foregoing descriptions are merely preferred embodiments of the present disclosure, and are not intended to limit the present disclosure. Any modifications, equivalent alternatives and improvements made within the spirit and principle of the present disclosure should be included in the protection scope of the present disclosure.

What is claimed is:

1. An apparatus for controlling a drum washing machine comprising a drum and a motor, the apparatus comprising:

a memory configured to store a program including program code; and a processor configured to execute the program stored in the memory to:

acquire an average starting power of the drum, by acquiring a starting power of the drum over a duration of time from starting the drum and integrating the starting power for the duration of time to acquire the average starting power;

acquire a load range to which a current load of the drum belongs, according to the average starting power of the drum by accessing a pre-stored corresponding relationship between each of a plurality of thresholds for the average starting power and a corresponding one of a plurality of load ranges, judging whether the average starting power is smaller than a first threshold, in response to judging that the average starting power is smaller than the first threshold, selecting a first load range of the plurality of load ranges as the load range to which the current load of the drum belongs, in response to judging that the average starting power is not smaller than the first threshold, judging whether the average starting power is smaller than a second threshold, and in response to judging that the average starting power is smaller than the second threshold, selecting a second load range of the plurality of load ranges as the load range to which the current load of the drum belongs;

set a velocity fluctuation threshold for weighing protection according to the load range to which the current load of the drum belongs by accessing a pre-stored corresponding relationship between each of the plurality of load ranges and a corresponding one of a plurality of velocity fluctuation thresholds, wherein each of the plurality of velocity fluctuation thresholds for weighing protection is smaller than a predetermined maximum weighing safety eccentric velocity fluctuation corresponding to a maximum load in the corresponding each of the plurality of load ranges, and the predetermined maximum weighing safety eccentric velocity fluctuation corresponds to a maximum weighing safety eccentric mass for entering a load weighing process; and control the motor to rotate the drum based on the velocity fluctuation threshold.

2. The apparatus according to claim 1, wherein:

the each of the plurality of velocity fluctuation thresholds for weighing protection is one of a plurality of predetermined maximum dehydration eccentric velocity fluctuations corresponding to the each of the plurality of load ranges; and each one of the predetermined maximum dehydration eccentric velocity fluctuations corresponds to a maximum dehydration eccentric mass.

3. A method for controlling a drum washing machine comprising a drum and a motor, the method comprising:

acquire an average starting power of the drum, by acquiring a starting power of the drum over a duration of time from starting the drum and integrating the starting power for the duration of time to acquire the average starting power;

acquire a load range to which a current load of the drum belongs, according to the average starting power of the drum by accessing a pre-stored corresponding relationship between each of a plurality of thresholds for the average starting power and a corresponding one of a plurality of load ranges, judging whether the average starting power is smaller than a first threshold, in response to judging that the average starting power is smaller than the first threshold, selecting a first load range of the plurality of load ranges as the load range to which the current load of the drum belongs, in response to judging that the average starting power is not smaller than the first threshold, judging whether the average starting power is smaller than a second threshold, and in response to judging that the average starting power is smaller than the second threshold, selecting a second load range of the plurality of load ranges as the load range to which the current load of the drum belongs;

set a velocity fluctuation threshold for weighing protection according to the load range to which the current load of the drum belongs by accessing a pre-stored corresponding relationship between each of the plurality of load ranges and a corresponding one of a plurality of velocity fluctuation thresholds, wherein each of the plurality of velocity fluctuation thresholds for weighing protection is smaller than a predetermined maximum weighing safety eccentric velocity fluctuation corresponding to a maximum load in the corresponding each of the plurality of load ranges, and the predetermined maximum weighing safety eccentric velocity fluctuation corresponds to a maximum weighing safety eccentric mass for entering a load weighing process; and control the motor to rotate the drum based on the velocity fluctuation threshold.

4. The method according to claim 3, wherein:

the each of the plurality of velocity fluctuation thresholds for weighing protection is one of a plurality of predetermined maximum dehydration eccentric velocity fluctuations corresponding to the each of the plurality of load ranges; and each one of the predetermined maximum dehydration eccentric velocity fluctuations corresponds to a maximum dehydration eccentric mass.

* * * * *